United States Patent [19]

Rössler

[11] 4,440,352

[45] * Apr. 3, 1984

[54] MACHINE FOR THE COMMINUTING OF BULK MATERIAL

[75] Inventor: Kurt Rössler, Belm, Fed. Rep. of Germany

[73] Assignee: Osnabrücker Metallwerke J. Kampschulte GmbH & Co. KG, Osnabrück, Fed. Rep. of Germany

[ * ] Notice: The portion of the term of this patent subsequent to Jun. 14, 2000 has been disclaimed.

[21] Appl. No.: 461,083

[22] Filed: Jan. 26, 1983

Related U.S. Application Data

[62] Division of Ser. No. 167,287, Jul. 9, 1980, Pat. No. 4,387,858.

[30] Foreign Application Priority Data

Jul. 14, 1979 [DE] Fed. Rep. of Germany ..... 2928471

[51] Int. Cl.[3] ..... B02C 18/12

[52] U.S. Cl. ..... 241/152 A; 241/161; 241/257 R; 241/261.1

[58] Field of Search ..... 241/46.06, 46.08, 152 A, 241/248, 101 B, 258, 101.4, 261, 257 R, 161, 241/261.1, 293, 294, 300.1, 296, 292.1, 243

[56] References Cited

U.S. PATENT DOCUMENTS

| | | | |
|---|---|---|---|
| 194,776 | 9/1877 | Hull | 241/243 X |
| 1,045,763 | 11/1912 | Whiting | 241/243 |
| 1,874,079 | 8/1932 | Black | 241/261.1 X |
| 2,297,604 | 9/1942 | Bateman et al. | 241/243 X |
| 3,883,321 | 5/1975 | Haverkamp | 241/46.17 X |
| 3,933,317 | 1/1976 | Rovere | 241/261.1 X |
| 4,171,103 | 10/1979 | Rossler | 241/152 A |

*Primary Examiner*—Mark Rosenbaum

*Attorney, Agent, or Firm*—Jordan and Hamburg

[57] ABSTRACT

A machine for comminuting bulk objects such as wood or the like includes a receptor forming in its lower part, a funnel, a guide means at the inner side of the funnel, a comminuting device below the funnel, and a transport and pre-breaking means within the funnel and rotating therein with the comminuting device. The comminuting device includes a rotor rotatable about a vertical axis and having a plurality of cutting edges and at least one stator mounted on the funnel and also having cutting edges. The cutting edges of the rotor traverse an annular working plane which is perpendicular to the rotational axis of the rotor with the annular working plane overlapping with the cutting edges of the stator. The rotor cutting edges, when viewed from the top and in the rotational direction of the rotor, are arranged at distances behind each other and in the back of free spaces extending along their lengths, the length of the cutting edges of the rotor being graduated and increasing in a direction opposite to the rotational direction of the rotor and up to the width of the annular working plane.

23 Claims, 14 Drawing Figures

MACHINE FOR THE COMMINUTING OF BULK MATERIAL

This is a division of application Ser. No. 167,287, filed July 9, 1980, now U.S. Pat. No. 4,387,858 issued June 14, 1983.

BACKGROUND OF THE INVENTION

The invention relates to a machine for the comminution of bulk material such as wood refuse or the like.

In one known machine of this type (DE-OS No. 2701 897) all the cutting edges of the rotor have identical length. Each cutting edge of the rotor circumscribes the same path of an annular working plane. The cutting edges of the stator which cooperate with the cutting edges of the rotor within one and the same step of comminution have among each other the same length also and therefore, among themselves, the same overlap with the annular working plane of the rotor cutting edges.

When one object or a plurality of objects reaches simultaneously a cutting edge of the rotor and the cutting edge of the stator nearest in the direction of rotation, comminution in that step of comminution occurs in one single cut. This cut is particularly in the case of comparatively rigid and/or also thicker and wider objects not a cut at a point which is advantageous for the use of power but rather an impact cut which shears through the whole length of the object. This causes high peak loads and frequent blocking, both occurrences which may deleteriously influence some parts of the machinery and the comminution process.

An objective of the present invention is the creation of a machine of the aforedescribed kind which cuts the material to be comminuted within one step of comminution in a plurality of consecutive partial cutting processes.

The machine according to the invention obtains efficient comminution of a great variety of objects, particularly objects a great bulk and/or material solidity by using simple means of construction of the machine at an increased service life. Furthermore, stand still periods due to blockages are considerably decreased.

DESCRIPTION OF THE PREFERRED EMBODIMENTS

Figure 1:
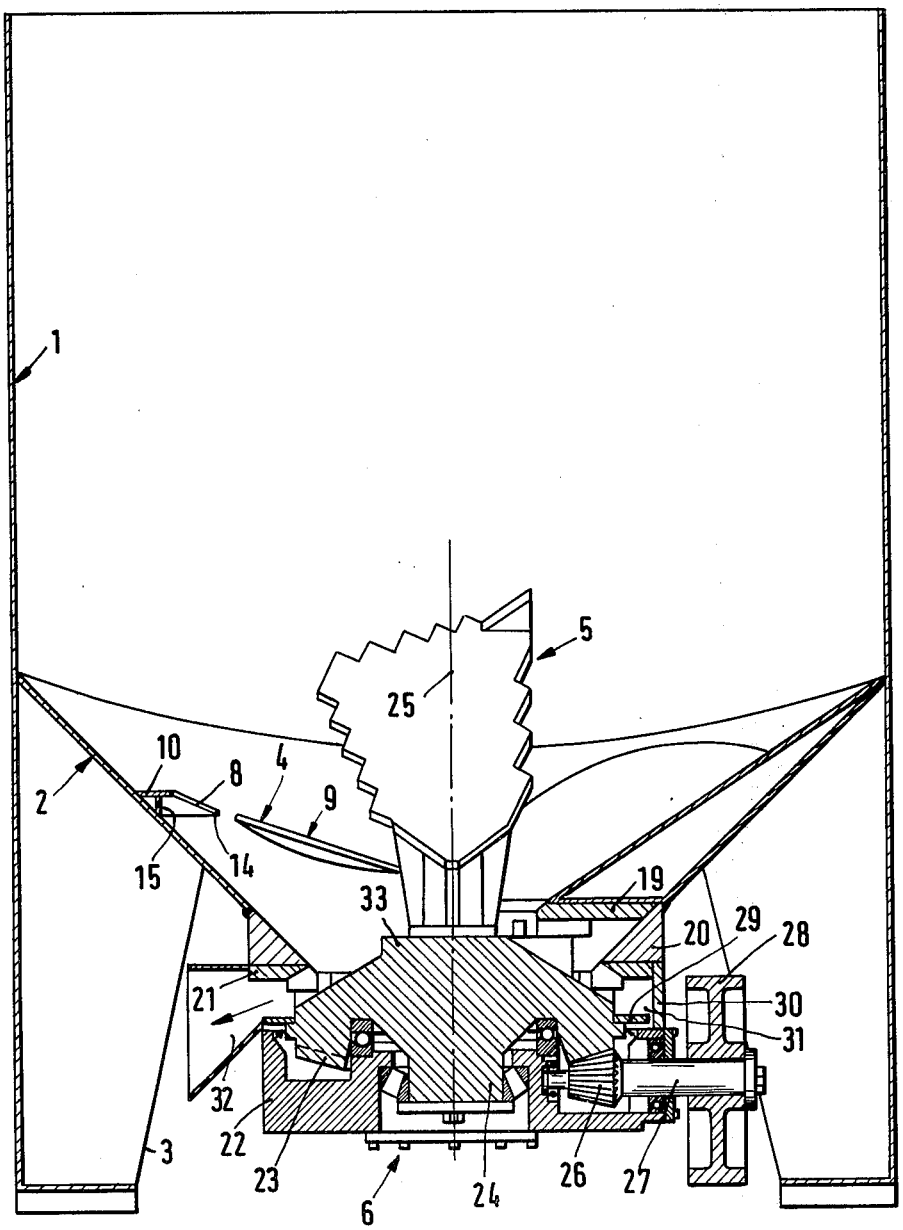
FIG. 1 is a partial vertical sectional view of the machine but with the transporting means and the pre-breaking means shown in elevation.

As can be seen in FIG. 1 the machine consists of an receptor 1 which stands upright and may be filled from its top. The main upper part has a square shape and the lower part leads into a funnel 2 whose horizontal cross section is circular. The whole acceptor 1, 2 stands upon legs 3.

A stationary guide means 4 is disposed on the inner side of the funnel wall. Furthermore, a transporting and pre-breaking means 5 rotates within the funnel 2, but the drive means therefore is not shown. A comminution device 6 which is fed with material to be comminuted is disposed below funnel 2.

Figure 2:
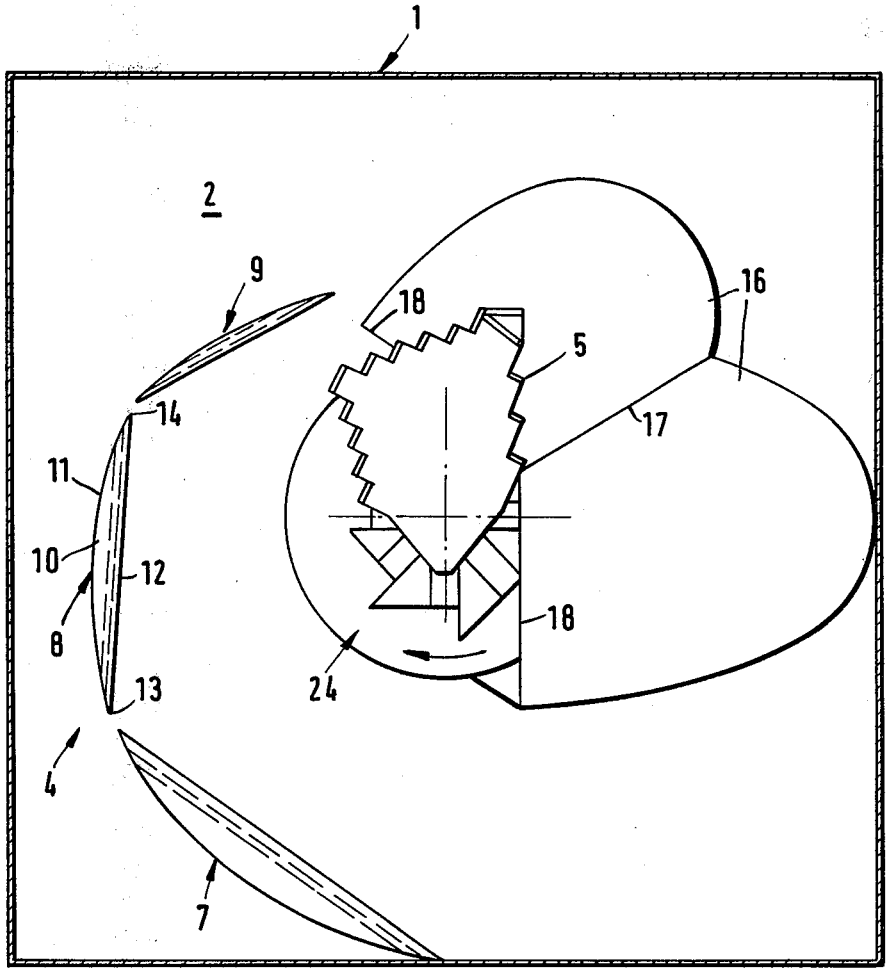
FIG. 2 is a top plan view of the machine shown in FIG. 1.

In the embodiment shown of FIGS. 1 and 2, the guide means 4 consists of three guide bars 7, 8 and 9 which are fastened to the inner wall of the funnel and are preferably welded to it. The guide bars 7, 8 and 9 may be arranged abuttingly behind each other or also, as shown, singly and at distances from each other. Each guide bar 7, 8 and 9 possesses an approximately horizontal leg 10 protruding into the funnel space and having an outer edge 11 which follows the shape of the funnel wall and having a straight, or in given cases slightly inwardly bent, inner edge 12 which forms a chord and connects two points 13 and 14 of the funnel wall. Leg 10 possesses at its underside a brace 15 which is approximately parallel to the vertical central axis of the container and which is backwardly displaced and extends outwardly relative to the inner edge 12 of leg 10, thus generally having the cross section of a slightly asymmetrical "T".

Each guide bar 7, 8 or 9 extends along the funnel wall at a sector angle of usually less than 90 degrees relative to the vertical central axis of the container and is therefore more or less oblique favoring various materials according to their physical quality. It is easily understood that the distances, number and arrangement of such guide bars may be made widely variable. The inner edge 12 acts as a guiding edge and simultaneously a breaking support in which case the brace 15 serves on one hand as a strengthening agent and on the other hand aids in preventing jamming of parts between the funnel wall and leg 10. All edges and limiting lines of the guide bars project from the funnel wall and change gradually into the funnel wall.

Furthermore, within the funnel 2 can be found bracing sheets 16 in the shape of elliptic cutouts which abut each other along a straight edge 17 and otherwise have straight edges 18 pointing towards the bottom of the funnel. These edges 18 correspond mainly (besides those parts which project and offer cutting edges) to the shape of the upper stator 19 which points towards the interior of the funnel, such stator being one of the components of the comminuting device.

A stator 21 of the comminuting device 6 is screwed to an annular flange body 20 provided on the interior end of funnel 2. Stator 21 is connected by non-illustrated spacer bolts or studs to a dish-shaped housing 22 of the comminuting device 6. Within the housing 22 is mounted pivotingly around a vertical rotational axis 25, a rotor 24 of the comminuting device 6, such rotor being furnished at its underside with a bevel gear 23. In this case the rotational axis 25 of rotor 24 coincides with the central axis of the container. The drive of the rotor 24 is actuated by the conical gear 26 carried on a rotatable shaft 27 which is mounted within housing 22. Shaft 27 carries on its outside solidly connected to it a drive gear 28 in the shape of a sprocket wheel, a flat belt plate or a V-belt pulley or similar means depending on which drive effect has to be transmitted by a non-illustrated electric motor or internal combustion engine which drives the rotor 24 by means of a chain or a belt. Rotor 24 carries on its lateral jacket plane a horizontal transport ring 29 which is surrounded by an upright standing ring 30, such ring 30 being fastened between the annular flange body 20 and the housing 22. This ring 30 delimits at the outside an output channel for comminuted material, such channel being fed by an output aperture 32.

The transporting part and pre-breaking means 6 is fastened to the upper horizontal median plane 33 of rotor 24, such means 6 being driven simultaneously with the rotor.

Figure 3:
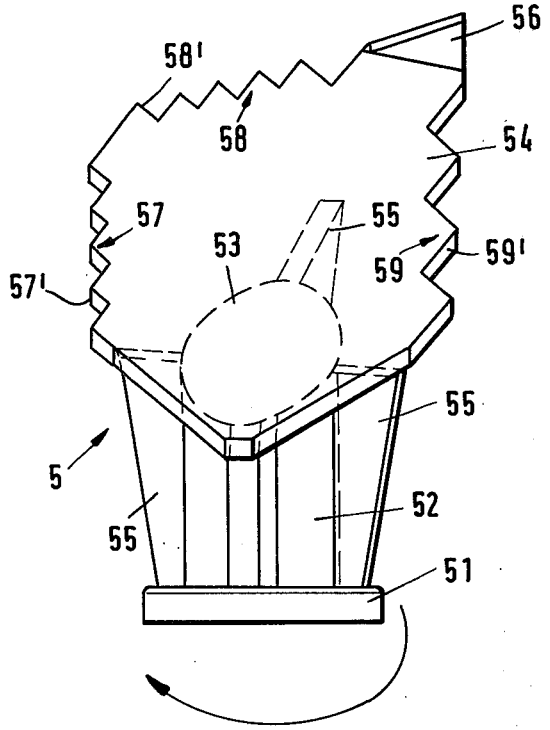
FIG. 3 is a perspective view of the transporting means and the pre-breaking means for the machine shown in FIG. 1.

As shown in FIG. 3, the transporting and pre-breaking means 5 of the embodiment according to FIGS. 1 and 2 consists of a horizontal flange plate 51 to which is fastened a vertical carrying axle 52. This carrying axle 52 has an upper carrying plane 53 approximately inclined corresponding to the inclination of the funnel wall. Plate 54 is fastened to this carrying plane 53 at a corresponding inclination. In order to make this plate 54 more rigid, support bars 55 are mounted on the carrying axle 52, such support bars 55 extending from the flange plate 51 to the underside of plate 54 and being welded to parts 51, 52, 54. At the upper end of plate 54 which is eccentrically based upon the carrying axle 52 is disposed an entrainment and breaking corner 56. The plane of this corner 56 which is visible in FIG. 3 forms with the rotational axis of the rotor an angle between 0 and approximately 45 degrees. In the embodiment shown, this angle amounts to 45 degrees. In the area of its edge, plate 54 is provided with step-profiles 57, 58 and 59 which may vary as to size and shape of their steps. In step profile 57 the step planes 57' points away from the directions of rotation and in profiles 58 and 59, the step planes 58' and 59' respectively, point towards the direction of rotation.

Figure 4:
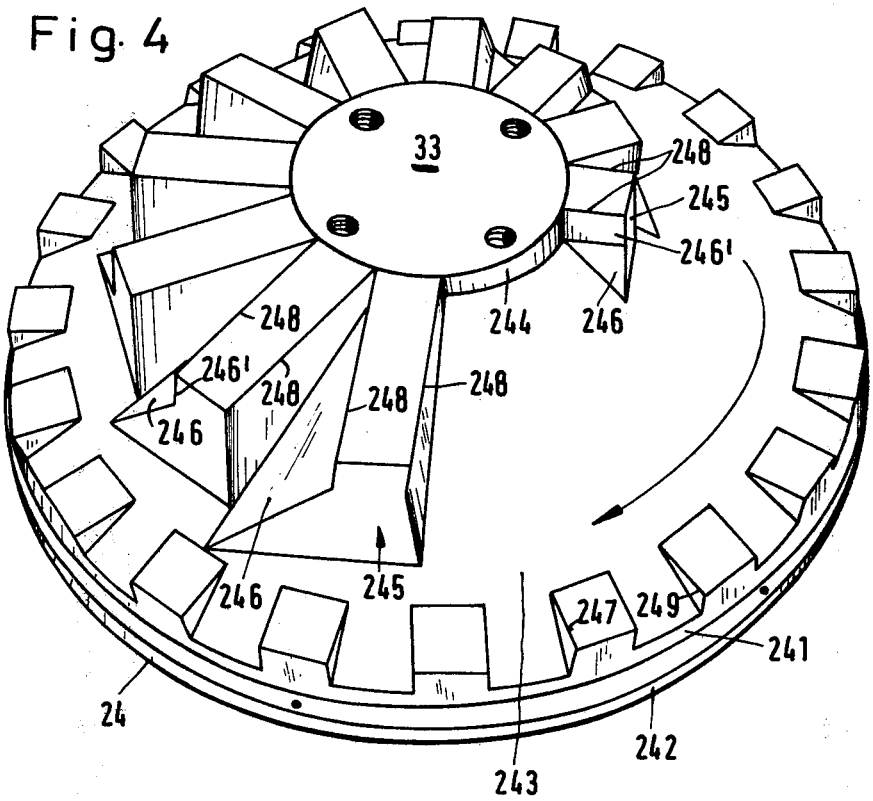
FIG. 4 is a perspective view of the rotor of the machine shown in FIG. 1.

As shown in FIG. 4 rotor 24 consists of a rotatable body with a cylindrical jacket plane 241 from which a collar 242 protrudes in order to support from below the transport ring 29 and to hold it fast. The jacket plane 241 changes downwards into the bevel gear rim 23 and is connected at its top by a conical plane 243 which rises towards the center of the rotor and is limited at its inside by a central middle area 244 which has a horizontal surface 33 which serves as a connection to the transporting and pre-breaking means 5.

From the upper plane 243 ribs 245 protrude upwardly in an approximate radially direction, and these ribs 245 have outer planes which point against the rotational direction and which also point towards the front, and are vertical. The frontal planes of ribs 245 located in back of the free spaces contain an oblique plane 246, whose bottom obliquely rises opposing the rotational direction and which becomes upwardly a vertical plane 246'. The approximately radial limiting edges of the plane surfaces of ribs 245 form the cutting edges 248 of rotor 24 in its first comminuting step. They may be formed, as usual, by separate cutting components which are set into the ribs and which may be exchanged when worn out. The lengths of the cutting edges 248 differ stepwise, running in a plane vertical with the rotational axis 25 of rotor 24 and running through a imaginary annular working plane whose width is determined by the length of the longest cutting edge 248 which in FIG. 4 is located on the anterior rib 245 pointing toward the viewer. Rib 245 shown in FIG. 4, to the right from the center area 244 and the first rib in the direction of rotation offers the cutting edges 248 whose lengths corresponds to a fraction only of the width of the imaginary annular working plane. Opposite to the direction of rotation, the lengths of the cutting edges 248 increases in steps consecutively from rib to rib, in which case the number of the step grades in FIG. 4 amounts to ten, but may vary without difficulties in a large range upwardly or downwardly.

The cutting edges 248 of rotor 24 graduated as to their lengths form a group arranged only upon a part of the whole circumference of the rotor, which in this example is distributed at a sector angle of 270° of the rotor. Instead of one such group the invention also provides a plurality of such groups of cutting edges, graduated as to their lengths, one behind the other in the direction of the rotation and fastened to the rotor.

The end points of the cutting edges 248 lying radially at the inside are in the embodiment of FIG. 4 all disposed upon an imaginary circle which forms the inner limiting line of the annular working plane and which coincides in the example shown with the outer circumferential line of the connecting plane 33. Instead of the extension of the cutting edges resulting from this construction, it is also basically possible to reverse the arrangement where all outer end-points of the cutting edges lie upon the outer limiting line of the annular working plane coaxial to the rotary axis of the rotor and the stepping down or graduation occurs towards the inside of the machine.

On its outer rim, rotor 24 has furthermore additional cutting edges 247, which are distributed at equal distances along the circumference, such edges 247 being formed by a lifter 249 forming a cutter crown. These additional cutting edges 247 lie in a plane which is perpendicular to the rotational axis of the rotor 25 and which is displaced axially downwardly relative to the annular working plane of the cutting edges 248. The plane perpendicular to the rotation plane of the rotor 25 coincides with the surface of the cutter crown 249 protruding from the conical surface 243. The additional cutting edges 247, all of the same length, have their outer ends disposed at the shell 241 of the rotor. Together with the corresponding cutting edges of stator 21 (described below) they form a second step of comminution of the comminuting machine 6 if that is desired for the desired degree of comminution. The additional cutting edges 247 may also be omitted, as shown in the rotor development according to FIG. 9.

Figure 5:
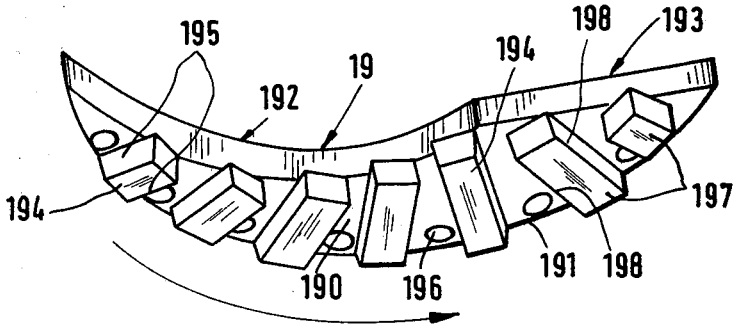
FIG. 5 is a perspective view of a first stator of the machine shown in FIG. 1.

FIG. 5 shows stator 19 for the machine shown in FIGS. 1 and 2. The shape of the stator 19 corresponds to rotor 24 of FIG. 4. This stator 19 consists of a plate body 190 with a circular outer edge 191, a spiral shaped inner edge 192, and a straight closure edge 193. On its underside, the plate body 190 carries blocks 194 with cutting edges 195. These blocks are by themselves or carry at their undersides correspondingly shaped exchangeable cutting parts. The plate body 190 of stator 19 is connected to the underside of the funnel 2. In the image of stator 19 of FIG. 5, seen obliquely from below, it is shown that the cutting edges 195 are also formed with steps of diminishing lengths, in which case the lengths of the cutting edges increase in the rotary direction of the rotor as shown. The cutting edges 195 of stator 19 overlap increasingly the annular working plane of the rotor cutting edges 248. The maximum length of cutting edges, thus the overlapping at block 194 from the left is at the fifth place. In front of each block 194 is a free space reaching radially outwardly from inside which secures a complete or full cut along the whole length of the cutting edge of all cutting edges 195.

On stator 19, the blocks 197 which follow block 194 with the longest cutting edges at a distance in the direction of the rotary direction of the rotor have additional cutting edges 198 whose lengths diminish in steps. These cutting edges are of prime importance when the direction of rotation of the rotor is reversed which is sometimes needed for short times when the machine has been jammed.

The cutting edges 195 protrude inwardly over the inner edge 192 of the plate body 190 of the stator 19 while, contrariwise, the cutting edges 198 protrude over the end closure edge 193.

Figure 6:
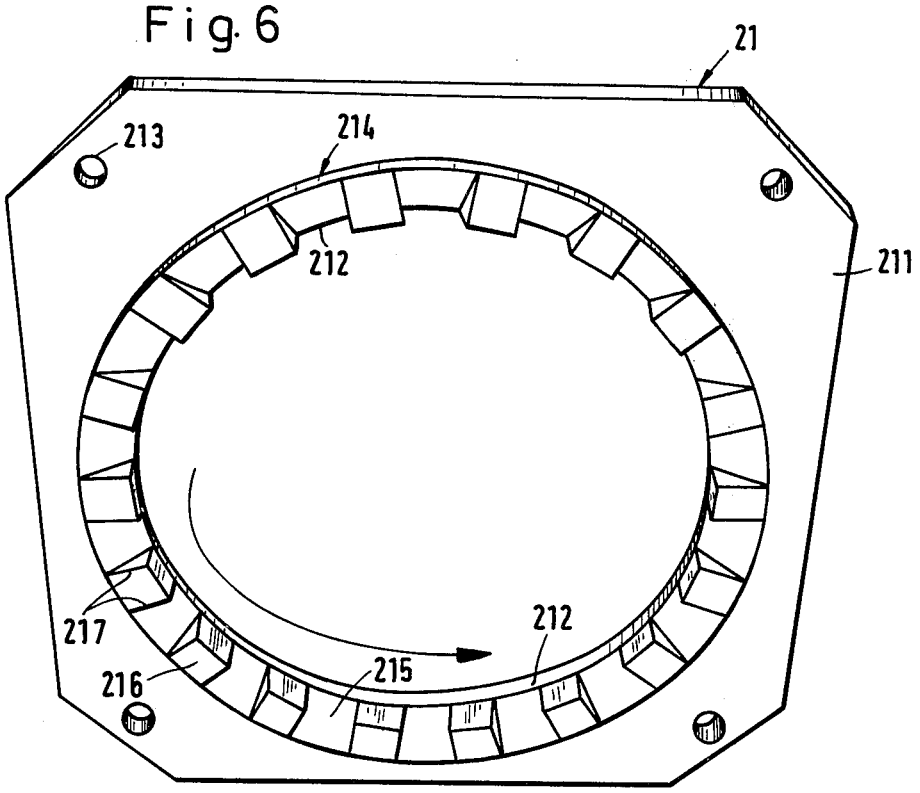
FIG. 6 is a perspective view of a second stator of the machine shown in FIG. 1.

It will be discerned in FIG. 6 that the lower, respectively, second stator 21 comprises a quadrilateral plate 211 whose corners are cut off and furnished with a large central bore hole 212. The plate 211 is fastened to the annular flange body 20 at the lower end of the funnel 2 by means of studs disposed in fastening bore holes. At the underside of plate 211 is a ring projection 214 having a triangular cross section. According to FIG. 6, which shows stator 21 obliquely from underneath, the base of the triangle forms an internal cone 215 from which protrude knobs 216 furnished with approximately radial cutting edges 217. These cutting edges 217 limit the flat surfaces of knobs 216 and run in a plane vertical to the rotational axis 25 of the rotor. The cutting edges 217 of stator 21 form together with the additional cutting edges 247 or rotor 24 the counter edges cooperating in the second step of comminution.

Figure 7:
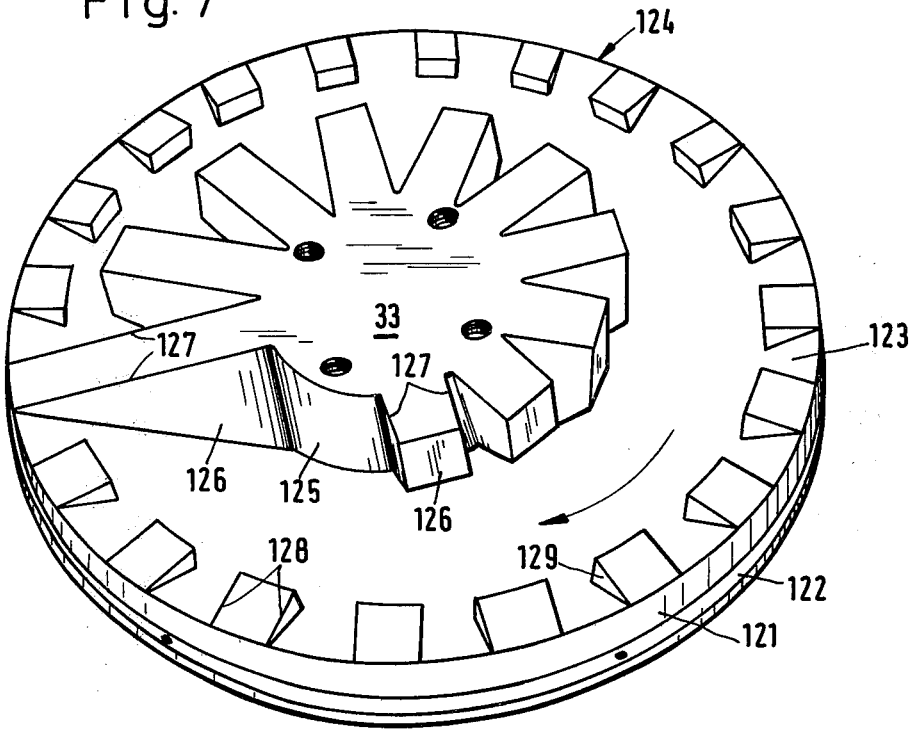
FIG. 7 is a perspective view of an alternate rotor.

FIG. 7 shows a rotor 124 of an alternate form where the rotor 124 is formed on its underside down to the cylindrical casing 121 with a collar 122 corresponding to rotor 24. In a difference from rotor 24, rotor 124 has its conical surface 123 being oblique inwardly, in other words as an internal cone. Within the center area of rotor 124, the internal conical surface 123 is limited by a cylindrical center zone 125, whose upper side forms again the flat connective plane 33, such plane 33 being vertical to the rotational axis 25 of the rotor and serving as a connection for the transporting and pre-breaking means 5. Two radially directed ribs 126 with cutting edges 127 are either integral parts of the cylindrical center zone 125 or are fastened onto it, respectively. Beginning at the first, shortest rib 126, these ribs increase their lengths in steps in a direction opposed to the rotation of the rotor. Rotor 124 is provided on its outer rim with additional cutting edges 128 which are distributed at equal distances and equal lengths and lie in a common plane with the graded cutting edges 127. The additional cutting edges 128 arise from knobs 129 which protrude upwardly from the internal conical surface 123.

In this embodiment also, the radial inner end point of all cutting edges 127 of the rotor is disposed upon an inner limiting line of the annular working plane crossed by the cutting edges 127, but, as already mentioned with regard to FIG. 4, it is also possible instead of that to have all the outer end points of the cutting edges 127 start upon an outer limiting line of an imaginary annular working plane, which is hypothesized as being coaxial with the rotational axis 26 of the rotor. In that case, the cutting edges will be graded and become longer inwardly opposite to the rotational direction of the rotor.

Figure 8:
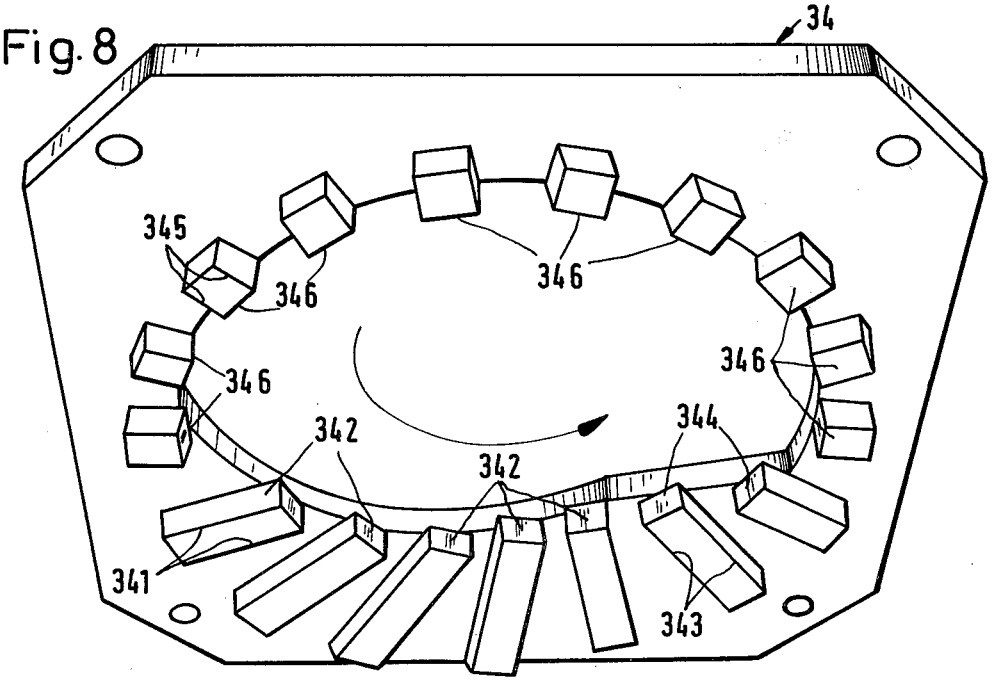
FIG. 8 is a perspective view from below of a stator for use with the rotor shown in FIG. 7.

FIG. 8 shows obliquely from below stator 34 for use with rotor 124 of FIG. 7. Stator 34 of FIG. 8 forms so to say the sum of the stators 19 and 21 according to FIGS. 5 and 6 because all cutting edges 127 and 128 of rotor 124 (FIG. 7) lie in one common plane. This sum of the stators 19 and 21 acts in such a manner that the cutting edges 341 of the blocks 342, the cutting edges 343 of the blocks 344 and the cutting edges 345 of the blocks 346 are all also disposed in a common plane which is vertical to the rotational axis 26 of the respective rotor 124 of FIG. 7. The conical plane 215 of stator 21 (FIG. 6) is deleted because such a plane is not needed for the guiding of chips which action is now exerted by rotor 124 of FIG. 7.

Figure 9:
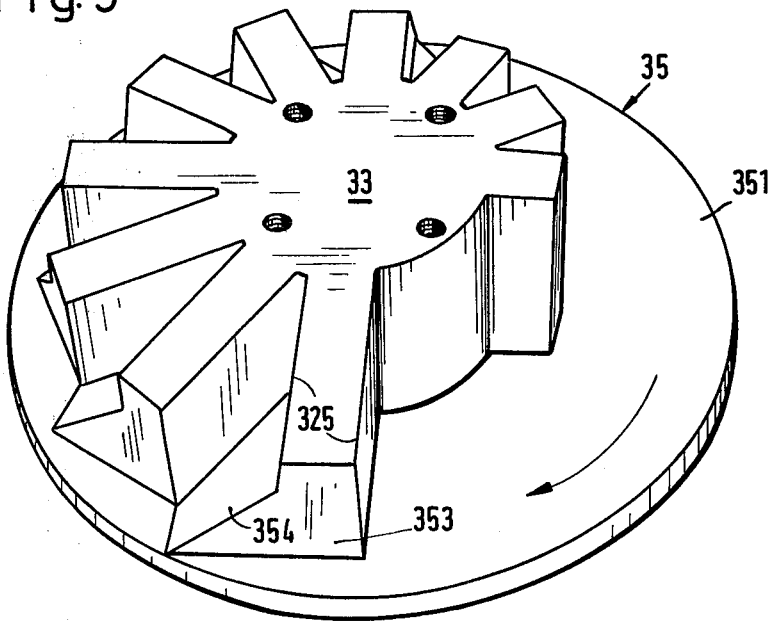
FIG. 9 is a perspective view of another alternate rotor.

FIG. 9 shows another variation of a rotor numbered 35. Rotor 35 coincides in its lower reaches with the shape of rotor 24, but contains a flat upper side 351 vertical to the rotational axis of the rotor. This upper surface 351 is furnished with a cap or rotor part forming cutting edges 351 and corresponds in its basic nature and function to the center part of rotor 24 in FIG. 4. The ribs 353 with their lengthwise graduated cutting edges 352 are furnished with oblique part planes 354 arranged frontally in the rotational direction. These oblique part planes 354 correspond to the oblique part planes 246 of the rotor in FIG. 4. The heights of the ribs 353 or the distance of the plane, furnished with the cutting edges 352, respectively, to the surface 351 of the rotor may be chosen according to the properties of the material to be comminuted. In rotor 24 of FIG. 4, the height of the cone influences also simultaneously the height of the ribs 245.

Figure 10:
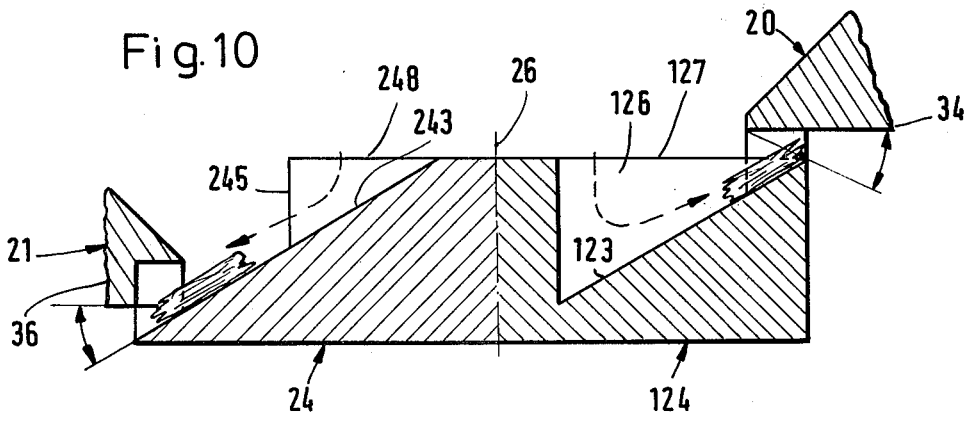
FIG. 10 is a detailed cross sectional view illustrating the path of a chip in various combinations of rotor and stator.

FIG. 10 shows right to the rotational axis 25 of the rotor a simplified cross section of the rotor 124 of FIG. 7 with the stator 34 of FIG. 8 at the underside of the annular flange body 20. FIG. 10 shows at the left side of the rotational axis 25 of the rotor a simplified partial section of a rotor 24 according to FIG. 4 together with a lower stator 21 according to FIG. 6 for the second step of comminution. Instead of the inner conical plane 215 of stator 21 according to FIG. 6, FIG. 10 chooses an embodiment similar to the stator 34 of FIG. 8. Here a ring 36, exchangeably fastened to the underside of plate 211 and surrounding the stator is provided in order to limit the passage of chips through the open spaces between the blocks of the stator which are provided with cutting edges.

Figure 11:
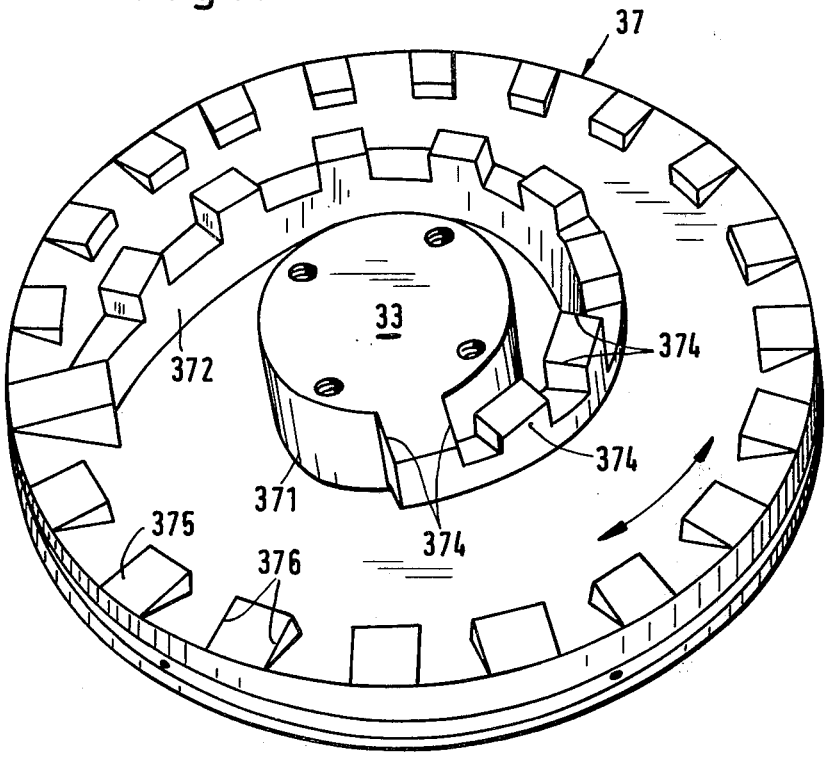
FIG. 11 is a perspective view of another alternate rotor.

FIG. 11 shows another variation of a rotor, number 37, which coincides generally with the one illustrated in FIG. 7. Instead of the ribs in FIG. 7 which begin in the cylindrical center area and are furnished with their respective cutting edges, rotor 37 is furnished with a spiral rib 372, beginning at its cylindrical central area 371. Blocks 373 with knife edges 374 are arranged upon and along spiral rib 372 extending in an approximately radial direction. The surfaces of blocks 373 with cutting edges 374 are disposed together with the surfaces of the rim side knobs 375 with their cutting edges 376 in a common plane, vertical to the rotational axle 25 of the rotor. The inner end points of the cutting edges 374 are disposed upon a spiral curve which begins at a distance from the rotational axis of the rotor 25 and widens thereafter. The spiral curve forms simultaneously an outer limiting line for an inside free space which has also a spiral shape and runs at the front of the cutting edges 374. The radial outside lying end points also of the cutting edges 374 are disposed upon a spiral which, on a corresponding graduation of the lengths of the cutting edges, increasingly widens opposite to the direction of rotation, or, like in the present limit case, runs parallel to the spiral of the inner end points. In that case, the cutting edges 374 are of equal lengths.

Figure 12:
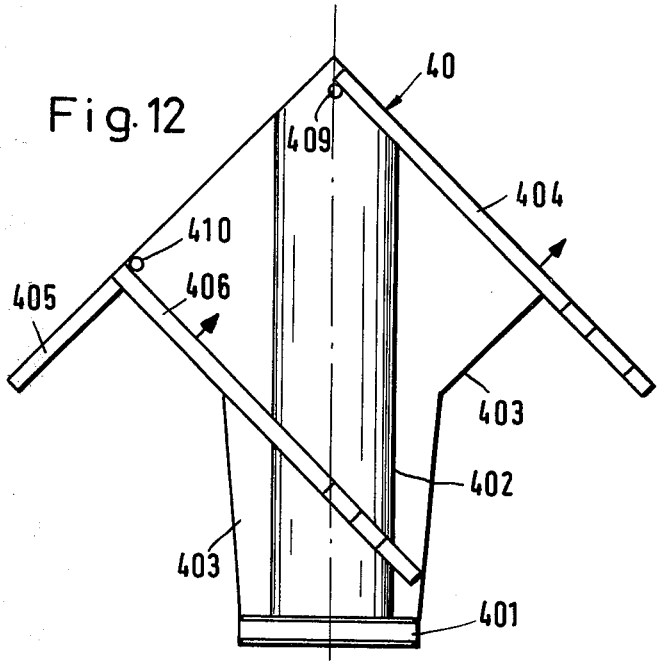
FIG. 12 is a side view of an alternate embodiment of the transporting and pre-breaking means.
Figure 13:
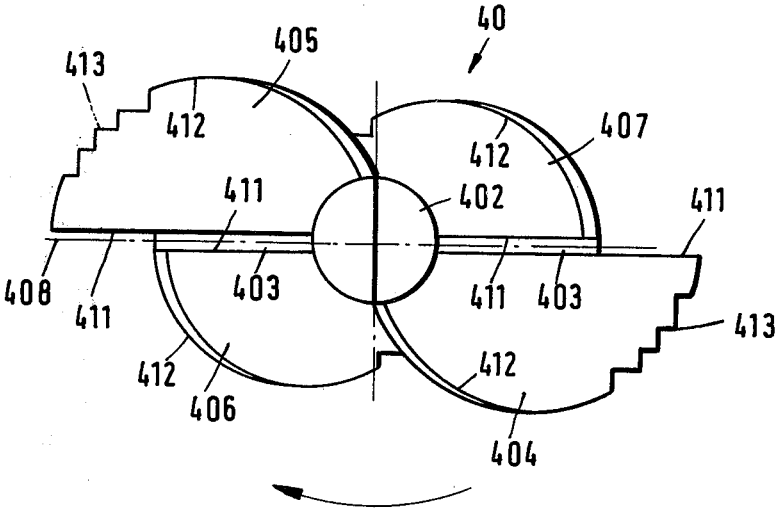
FIG. 13 is a top plan of FIG. 12.

FIGS. 12 and 13 show a variation of a transporting and pre-breaking means numbered 40, particularly advantageous for certain flexible materials. Upon a connective flange plate 401 is disposed a vertical bearing axle 402 with supporting-bars 403 connected to it. The upper end is oblique in a roof-type shape corresponding to the funnel wall. From this upper end of the bearing axle 402 start two upper plates 404, 405, which are offset by 180 degrees in the direction of the circumference and which extend obliquely downwardly, opposing each other. Under each of the upper plates 404, 405 is disposed an underplate 406, 407. Plate 406 forms with plate 404 a plate-pair lying at one side of an axial plate 408 across the bearing axle 402. Plate 406 is parallel to plate 404 and is disposed in such a manner that its position may be reached by a translational motion along a line vertical to the plane of plate 404. The same statement is valid for the plate-pair 405,407.

Plates 404, 405, 406 and 407 may be rigidly connected to the bearing axle 402 and the support bars 403. Another possibility is schematically suggested in FIG. 12, that is, to couple each plate hingeable at a hinge on the bearing axle or the support bars, respectively. For that case a possible hinge for plates 404 to 409 and one for the plate 406 at 410 is suggested in the drawing. Corresponding hinges are also provided for plates 405 and 407.

In the embodiment shown, all plates show a straight rear edge 411 and a curved, for example elliptical frontal edge 412. Instead of a curved frontal edge, an oblong plate, for example, may be provided. All plates are provided with a step profile 413 in the area of their frontal edges and in the vicinity of their individual bottom ends.

The aforedescribed machine works as follows.

Objects whose workable dimensions are given by the size of receptor 1 are fed into receptor 1 and funnel 2, are caught within the path of the transporting and pre-breaking means 5 and pressed against the walls of the receptor 1 and funnel 2, including the guide bars 7, 8 and 9, of the guiding means 4, disposed therein which act as a counter-thrusting wall. Here the objects are deformed or broken. The brace legs 15 of the guide bars 7, 8, 9 prevent jamming of the material because they form a repelling angle with the legs 10. In order to prevent bridging in the area where the receptor 1 becomes funnel 2, the transporting and pre-breaking means 5 protrudes with its upper point 56 upwardly over this area. By the aid of plate 54 of means 5 lying obliquely parallel to the oblique funnel wall and the steps 59' of the step profiles 59 pointing in the direction of rotation, means 5 is capable of turning without great exertion in the filled funnel 2. Here it deforms, breaks or tears, respectively by approximately point-shaped pressure the goods lying in front of step 59', or at least transports them further on. The step planes 57', 58' act like paddles. While the upper step planes 58' lift the objects with their point and press them upwardly, the step planes 57 press them with their points downwardly. A constant revolution of the material occurs thereby in funnel 2 which forces them to comminute each other and which also prevents any jamming. The catch or breakpoint 56 particularly grips large objects in order to pre-break them in cooperation with the breaker edges of the guide means 4. Thus the guide means 4 fulfils a double function insofar as it acts on the one hand with its edges as a counter thrust to breaking when transport and pre-breaking means 5 moves towards these edges. On the other hand, guide means 4 works as a guide when means 5 moves with its plate 54 along the guide means 4 and over it. The aforedescribed procedure shows that the transport and pre-breaking means 5 is particularly well adapted to the precomminution of breakable objects like chip board, shelving, beams, pellets, boxes, orange crates, dry branches, tree-parts, etc. For other objects, for instance, wet flexible wood, veneers, straw, and cardboard, a transport and pre-break means 40, according to FIGS. 12 and 13, is more advantageous. For that purpose, the two upper plates 404 and 405 run with their outer ends close to the funnel wall and grip thin goods, pull them inwards and transfer them to the lower plates 406 and 407. The bending caused by this process causes a stress of the materials above their bending or tear-resistance, respectively, so that they too break or tear. The lower plates 406 and 407 press the objects lying within their area downwardly towards the comminution device 6. Increase and judicious arrangement of the guide bars corresponding to the guide bars 7, 8 and 9 allows regulation of the device to comminute any kind of objects under optimal conditions.

Once the objects have obtained a certain size due to the pre-comminution, they are forced by gravity and the transport and guiding effect between the means 5 or 40 and 4, respectively into the cutting area or rotor 24 and the stators 19 and 21.

Larger or thicker pieces, which partly still abut the wall of funnel 2 are tangentially pulled through by the rotating rotor 24 until a part lies upon the free conical plane 243 and the first smaller ribs 245 can grip it. Once they have gripped, the longer and thicker pieces are pulled under the stator 19 so far that they are caught by the blocks 194. The continually turning rotor 24 splits and breaks now by the ribs 245, furnished with cutting edges 248 the material and pushes the split and broken material towards the cylindrical median area 244 and distributes the material over each individual rib. When the rotor keeps on turning the split and broken material reaches that point where a cutting edge 248 of a corresponding rib 245 reaches a cutting edge 195 upon a block 194 of stator 19, in which case the length of the block must fit the rib 245. That causes the material to be cut at one point from the inside outwardly. The cutting or shearing process moves the material from inside outwardly under the stator 19. The radially outwardly enlarging free space between the blocks 194 of the stator prevents any jamming of the cut material. Gravitational force, the conical shape of the rotor surface 243 and centrifugal power transport the cut material towards the outer rim of rotor 24. Material turning along endeavors now to reach tangentially between the knobs 216 of the second, lower stator 21. If it has a sufficient piece size, it pushes itself between two knobs 216 where the conical lane 215 presses it downwardly and in front of the cutting edges 217 of the knobs 216. A renewed cutting process of a second comminution step occurs now between the cutting edges 217 of the knobs 216 and the cutting edges 247 of the knobs 249 of the rotor. Pieces of material which were comminuted in the first comminution step which do not yet fit between the knobs 216 of the stator 21 are so to say picked up by the oblique planes 246 in the free spaces in front of the ribs 245 and again led to the cutting edges 248 of the ribs 245 of rotor 24 and cut again. Material lying in front of the knobs 249 of rotor 24 and having been cut in the second comminution step is transported by centrifugal force and the pressure of the following material from inward outwards onto the transport ring 29 which transports it further to the ejection port 32 where it is ejected by centrifugal force. In case of moist material, a wiper is provided in the area of the ejection port which wipes such material off the transport ring 29. The wiper not shown.

The aforedescribed method of working of the machine according to FIGS. 1 and 2 shows that the machine is capable of performing heavy duty comminution work. In order to visualize the conditions, it has to be pointed out that the acceptor of a medium large machine has a volume of about 6 $m^3$ (7.8 cubic yard). In order to furnish the forces needed for the comminution of such a volume, a correspondingly big gear reduction is needed in order to produce sufficiently low rotations per minute of the rotor. For such lower rpm of the rotor, its conical plane 243 is important for a trouble-free transport of material in the area of the comminution device in order to aid the centrifugal effect. For such comparatively low rpm also the construction and arrangement of the transport and pre-breaking means 5 is attuned because higher speeds of rotation could lead to undesirable unbalance effects due to its eccentricity. For higher rpm as they might be desired for light comminution work in order to obtain a larger output, it is recommended to use a transport and pre-breaking means according to FIGS. 12 and 13. For such higher rpm, a rotor according to FIG. 7 associated with a stator according to FIG. 8 is highly recommended. The result is a simplification of construction while keeping the transporting and cutting work constant. A difference, though, is the transportation of material due to the inner conical shape of the rotor surface 123. That must be actuated exclusively by centrifugal force which must transport upwards to the knobs 129 all materials which were comminuted in the first comminuting step by the cutting edges 127 and 341. Pieces not yet fitting in their size for the consecutive comminution in the second step of comminution are pushed upwardly by centrifugal force towards knob 129 and are prevented from further rotation by the stator 34, so that these lumps of material pile up in front of the stator until they are again caught by the ribs 126 and are again comminuted in the first comminution step.

A rotor 35, built according to FIG. 9 is particularly useful for the treatment of production refuse and seconds, as represented for instance by plastic containers and pressed screens resulting from the production of packing materials. Rotor 35, provided with a flat upper surface 351 has a very good ability of grip in conjunction with the shape of the ribs 353 and their cutting edges 352, a construction which prevents easily deformed materials from slipping away. The rotor 35 is capable of cooperating with the normal stator 19 according to FIG. 5. Basically, all these rotor-stator combinations may lead in certain cases to blocking of the rotor which may, for instance, because by steel parts, an unfortunate accumulation of goods hard to be comminuted, etc. The machine turns itself off automatically under such circumstances and is reversed after a short time due to certain technical reasons, in other words, the rotation of the rotor will be reversed. That relieves the blockage, so that consecutively the machine can be adjusted again for normal activity. Such a method of working with reversing has no importance for work with easily comminuted goods because blockages do not occur so frequently under such circumstances. But there are special cases where they occur, for instance with rubber. Rubber needs due to its compactness as a block and due to its great toughness frequent reversals, which might lead in embodiments of the machine according to FIGS. 4, 7 and 9 to an undesirable loss of efficiency. For such special cases particularly, rotor 37 according to FIG. 11 is very interesting. Here the arrangement of the inner and the outer end points of the cutting edges 374 upon a spiral line in connection with an inner spiral shaped free spaced leads to a gradation of the cutting edges in both direction of rotation of rotor 37. A stator belonging to a rotor according to FIG. 11 would be similar to the stator according to FIG. 5 which already provides two blocks 197 with oppositely disposed gradation of lengths of the cutting edges 198. A stator for the rotor according to FIG. 11, derived from stator 19 of FIG. 5 would show instead of edge 193 an additional or wider spiral shaped edge 192 having opposite curvature. Underneath this second inside spiral shaped part, it would be furnished with a set of cutting edges which would corresond relative to the backwards rotation of rotor 11 to the set for the forward rotation in FIG. 5. If now the machine, when comminuting rubber parts, is blocked in the forward direction of the rotor or is excessively braked, respectively, the machine is switched back and runs with the rotor in reverse until again blocking or excessive braking occurs. The comminution output obtained by such a practice differs only slightly from a continual mode with only one direction of rotation of the rotor for the comminution process.

All rotors shown have cutting edges for the first step of comminution belonging to a single group. For very large rotors with large diameters, particularly, a plurality of such groups may be provided upon one rotor where it is also possible to let the graduation of lengths of one group increase from inside out and of another group from outside in.

For very fine comminution, it may also be advantageous to increase the number of additional cutting edges in the area of the outer rim of the rotor. Additional ring rows of additional cutting edges belonging to one and the same rotor would therefore lead to additional steps of comminution through which the material would be transported by centrifugal force.

Possibilities of change in order to accommodate the comminution device 6 to various materials embrace the construction of rotors and their stators. By changing the number of the cutting edges, graduated as to their lengths for the step of comminution, a finer or coarser system of comminution arises, which reacts upon the degree of comminution and the ability to grip like a change of depth of the free zones in front of the cutting edges. By deleting the depths of the free zones in front of the cutting edges, it is possible to theoretically chose such a negligible depth that the cutting plane of the rotor is formed only by cutting edges having a sawtooth shaped sectional profile, but which nevertheless change their lengths in steps. This case leads simultaneously to a very fine graduation of lengths.

Other possibilities of variation are offered by the angles between the cutting edges of the stator and the rotor which can increase or lower the angle of cut. In such a case, it is necessary to take care that the function of the point can be preserved.

Another changeable quantity is the angle of cross section of the cutting edges which may be varied between an obtuse and an acute angle. Furthermore, the cutting edges may have a curved shape instead of the generally illustrated straight shape.

It should be mentioned here that the sum of lengths of graduated cutting edges is constant when the stator and rotor contain equally graduated cutting edges, a fact which leads to uniform wear or an extended general working life, respectively.

Figure 14:
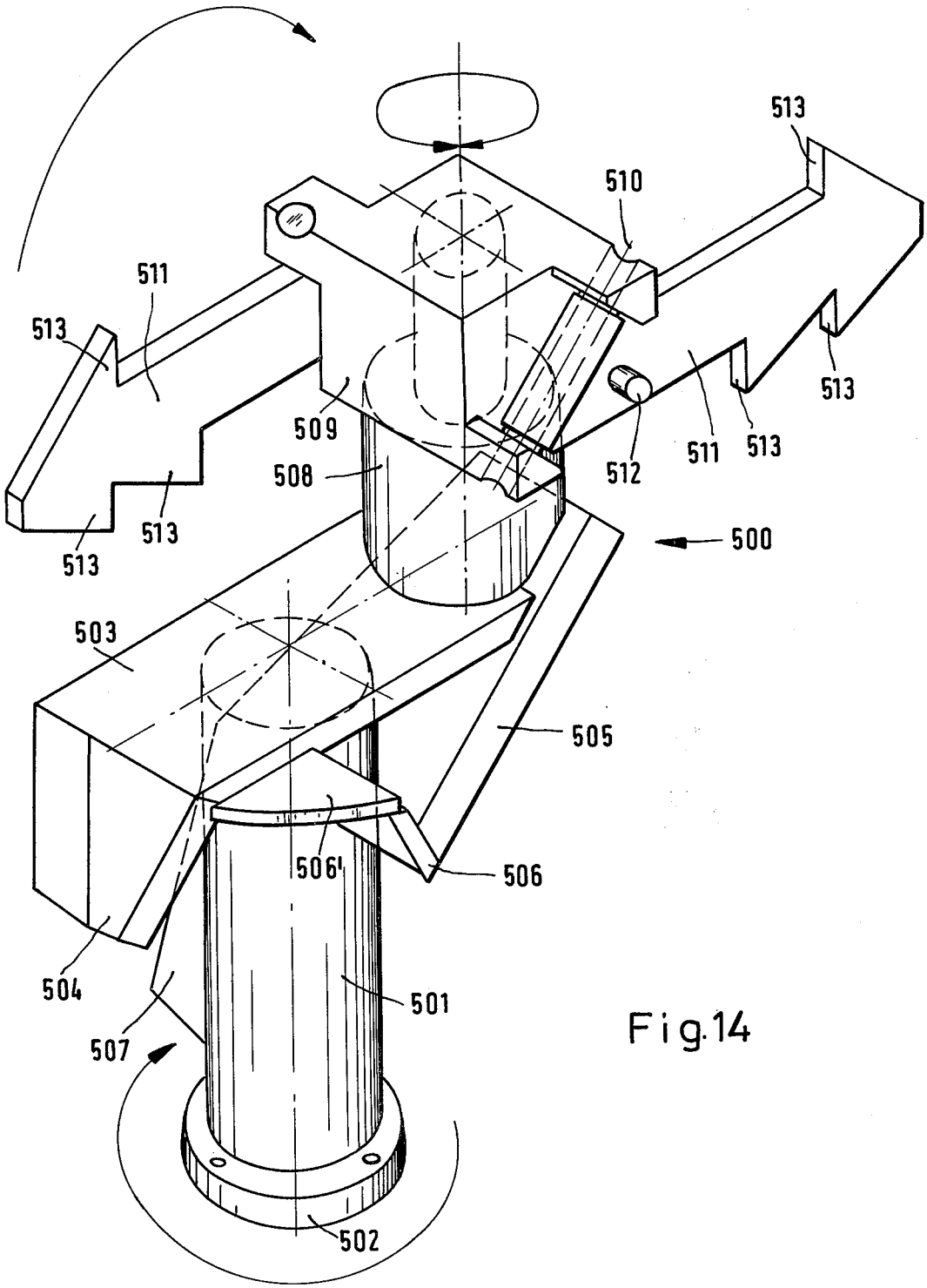
FIG. 14 is a perspective of a third embodiment of the transporting and pre-breaking means.

Instead of transport and pre-breaking means 5, 40, as shown in detail in FIG. 3 or 12, respectively, a transport and pre-breaking means may be provided as shown in FIG. 14. The transport and pre-break means 500, shown in FIG. 14, has a bearing axle 501 which is fastened by means of a flange plate 502 to a rotor, for instance, the rotor 24 and is coaxial with it. The bearing axle 501 carries at its upper end a solidly connected, for instance welded-on, crossplate 503. This crossplate 503 protrudes over the bearing axle 501 and possesses at one end a bent part 504 disposed at a right angle to the funnel wall of the funnel 2. At its opposite end, the crossplate 503 is connected to an obliquely rising plate 505 which is parallel to the funnel wall. The plate 505 reaches at one side downwardly to the bearing axle 501 and protrudes slightly over the plane of the crossplate. Plate 505 has two lower ears 506 and 507, one of which being a continuation of plate 505 in front of the bearing axle and the other being at an angle upwards and reaching in front of the bearing axle 501 upwardly to the crossplate 503. The end of the ear 506 which protrudes laterally under the crossplate 503 may be connected to a nodal plate 506' which is arranged approximately at the height or level of the crossplate 503 and is connected to it. The oblique plate 505 with its ears 506 and 507 forms a strut for the crossplate 503 against the bearing axle 501 and has the transport and breaking effect of a wormgear helix segment. The ears 506 and 507 cooperate in this effect and aid in stabilizing the construction. Such a basic construction of the transport and pre-break means by itself may be found of use in machines according to the invention which are mainly fed for comminution with lumpy and not too bulky material.

In certain cases though, where extremely light objects having large planes or volumes, like veneer cuttings, large cartons, films, etc. have to be crushed and are fed in either alone or together with lumpy material, the danger occurs that such objects lie flat against the funnel wall and thus evade an efficient transport into the comminution process. For such cases the crossplate 503 carries at its transition to plate 505 a vertical bearing axle 508 which supports a freely swivellable tension-arm support 509 to which at least one horizontal tension-arm is fastened. If the tension-arm support 508 is furnished with one single tension-arm 511 only this arm may be rigidly connected to its support, welded, for instance. If, as shown in FIG. 14, the tension-arm support 509 carries two (but also three or more) tension-arms 511, these arms are preferably hingeably fastened to the tension-arm support on a hinge-axle 510. The tension-arms 511 may be swivellable out of their approximately horizontal position into a vertical alternate position by an angle of about 180 degrees. Such a transport and pre-break means is a universal device that not only transports and leads into comminution veneer cuts, cartons, films and similar flat objects but which is particularly capable or transporting and breaking large and bulky objects like pallets, plates, etc. thus making it possible to run a process where such articles may be mixed.

Objects fed into the acceptor 1 with funnel 2 transmit a to-and-fro motion to the tension-arms 511 due to their eccentric position and the free swivelability of the tension-arm support 509. This motion moves the tension-arms 511 alternatingly into the collection of the fed-in material and out of them, in which case they drag along towards the center of the container or funnel, respectively all the objects which they had gripped while moving outwardly. By this action these objects reach the crossplate 503, 504 and then plate 505, which transport, sometimes by breaking them, these objects mainly due to their helix-conveyor action towards the cutting plane of the first cutting step. If too large an accumulation of material exists in front of the tension-arms 511 when they push forwards and outwards, these tension-arms are, due to their swivelability, able to move from their horizontal position into a vertical shunt position, which is particularly desirable when the machine is fed only with heavy and hard objects like chipboard, etc. or when such material is mixed with lighter material. Gravity forces steadily the tension-arms 511, which preferably are provided underneath and on top with hook-shaped projections 513 to return to their horizontal position according to FIG. 14. Bumpers 512 provided at both sides of the tension-arms 511 brace the tension-arms 511 against their tension-arm support 509 in their horizontal position and in their vertical shunt position. Simultaneously these bumpers may serve as noise reducers when they consist of a plastic or a similar material.

What is claimed is:

1. In a comminution apparatus, the combination comprising a housing for receiving material to be comminuted, a stator mounted in said housing, said stator having stator cutting edge means, a rotor rotatably mounted in said housing for rotation about a vertical axis, said rotor having rotor cutting edge means, said stator cutting edge means and said rotor cutting edge means each having a plurality of cutting edges which cooperate during rotation of said rotor to effect comminution of said material, said cutting edges each having an outer terminating end and an inner terminating end, at least one of said cutting edge means having the cutting edges thereof disposed in a common plane which is perpendicular to said vertical axis, said cutting edges disposed in said common plane having at least one of their terminating ends disposed along a spiral path, whereby the cutting edges having their at least one terminating ends disposed along a spiral path have cutting edge sections progressively radially displaced considered in the direction of rotation of said rotor such that the material being comminuted is engaged at progressively radially displaced locations by said progressively radially displaced cutting edge sections.

2. In a comminution apparatus according to claim 1, wherein said at least one cutting edge means is the rotor cutting edge means and has cutting edges constructed with progressively longer rotor cutting edges.

3. In a commintuion apparatus according to claim 2, wherein said stator cutting edge means has cutting edges constructed with progressively longer stator cutting edges.

4. In a comminution apparatus according to claim 2, wherein said progressively longer rotor cutting edges are spaced from one another at a distance which is less than the distance that the longest rotor cutting edge is spaced from the shortest rotor cutting edge such that the progressively longer rotor cutting edges are disposed only over an annular portion of said rotor.

5. In a comminution apparatus according to claim 2, wherein said rotor cutting edges having their radial inner ends terminating on a circle, the center of said circle being coincident with the axis of rotation of said rotor.

6. In a comminution apparatus according to claim 5, wherein said rotor cutting edges have their radial outer ends terminating along said spiral path.

7. In a comminution apparatus according to claim 1, wherein said at last one cutting edge means is the stator cutting edge means and has cutting edges constructed with progressively longer stator cutting edges.

8. In a comminution apparatus according to claim 7, wherein said stator cutting edge means further comprises a plurality of progressively shorter cutting edges which, considered in the direction of rotation of said rotor, are disposed after said plurality of progressively longer stator cutting edges.

9. In a comminution apparatus according to claim 1, wherein said stator cutting edge means and said rotor cutting edge means each comprises a plurality of second cutting edges disposed generally radially outwardly of the first said respective cutting edges, thereby providing for two-step comminution.

10. In a comminution apparatus according to claim 9, wherein said second rotor cutting edges are at an outer peripheral portion of said rotor, said second stator cutting edges cooperating with said second rotor cutting edges to define the second step for said two-step commintuion.

11. In a comminution apparatus according to claim 10, wherein the first said rotor cutting edges and said second rotor cutting edges are disposed in a common plane.

12. In a comminution apparatus according to claim 9, wherein said second cutting edges of said stator are constructed with progressively longer cutting edges considered in the direction of rotation of said rotor.

13. In a comminution apparatus according to claim 9, wherein said second cutting edges of said stator are constructed to have equal lengths.

14. In a comminution apparatus according to claim 1, wherein said housing comprises a funnel having a funnel wall.

15. A machine according to claim 14, wherein said guide means (4) at the inner wall of the funnel (2) is formed by at least one guide bar (7,8,9) which is fastened to the funnel wall and is inclined downwardly, said guide bars (7, 8, 9) being provided with an approximately horizontal leg (10) protruding into the funnel space and moving an outer edge (11) following the course of the funnel wall and having an inner edge (12) connected to points of the funnel wall (13, 14) and which has a bracing leg (15) on its underside, said bracing leg (15) being approximately parallel to the rotary axis (25) of said rotor and being outwardly offset relative to the inner edge and connected to said funnel wall.

16. A machine according to claim 14, wherein said guide means (4) comprises a plurality of guide bars (7, 8, 9) formed as sectors, said sectors having an angle which is less than 90 degrees.

17. A machine according to claim 14, including transport and pre-breaking means (5) which comprises a substantially flat plate (54) disposed obliquely and approximately parallel to said funnel wall, said plate (54) being provided along its rim areas with step profiles (57, 58, 59), said step profiles (57, 58, 59) pointing in groups either towards the direction of rotation of the plate or against the direction of rotation of the plate.

18. A machine according to claim 14, including transport and pre-breaking means (40) which comprises two pairs of plates (404, 406; 405, 407) carried by a rotatable support axle (402) said pairs of plates being offset by an angle of 180 degrees and each pair in itself being approximately parallel, whereby each of the upper plates (404, 405) of each plate pair begin at the upper end of the support axle (402) and incline obliquely downwardly and outwardly and where each of the lower plate pairs (405, 407) are disposed offset and parallel to the upper plates and where all plates are provided with an anterior edge with a step profile (413) and a straight posterior edge (411), both edges being disposed in the lower area of said plates, said posterior edge (411) coinciding with an axial plane (408) through the support axle (402).

19. A machine according to claim 18, wherein said upper plates and said lower plates (404, 405; 406, 407) of both plate pairs are hingably supported by a hinge axle (409, 410).

20. A machine according to claim 14, including transport and pre-breaking means (500) which is provided with a support axle (501) which is coaxially fastenable to a rotor by means of a flange plate (502) and wherein said support axle (501) is provided with a horizontal crossplate (503) protruding at both sides over the support axle and having at one end a bent piece (504) which extends obliquely downwardly and is approximately vertical relative to the funnel wall and connected at its opposite end to an obliquely upwardly extending plate (505) which is approximately parallel to the funnel wall, said plate (505) reaching on one side down towards the support axle and protruding at its other side upwardly above the plane of said crossplate.

21. A machine according to claim 20, wherein said plate (505) has two lower extensions (506, 507), one of them being an elongation extending downwardly in front of said support axle (501) and the other being bent upwardly and extending upwardly to the crossplate in front of said support axle.

22. A machine according to claim 21, wherein said crossplate (503) carries at its transition to plate (505) a vertical bearing axle (508) unto which freely pivots a tension-arm support (509) provided with at least one horizontal tension-arm means (511).

23. In a comminution apparatus, the combination comprising a housing for receiving material to be comminuted, a stator mounted in said housing, said stator having stator cutting edge means, a rotor rotatably mounted in said housing for rotation about a vertical axis, said rotor having rotor cutting edge means, said stator cutting edge means and said rotor cutting edge means each having a plurality of cutting edges which cooperate during rotation of said rotor to effect comminution of said material, said cutting edges each having an outer terminating end and an inner terminating end, at least one of said cutting edge means having the cutting edges thereof disposed in a common plane which is perpendicular to said vertical axis, the last said cutting edges having at least one of their terminating ends disposed along a spiral path, whereby the cutting edges having their at least one terminating ends disposed along a spiral path have cutting edge sections progressively radially displaced considered in the direction of rotation of said rotor such that the material being comminuted is engaged at progressively radially displaced locations by said progressively radially displaced cutting edge sections, said stator cutting edge means and said rotor cutting edge means each comprising a plurality of second cutting edges disposed generally radially outwardly of the first said respective cutting edge thereby providing for two-step comminution, said second rotor cutting edges being at an outer peripheral portion of said rotor, said second stator cutting edges cooperating with said second rotor cutting edges to define the second step for said two-step comminution, the first said rotor cutting edge being disposed in a first plane perpendicular to the axis of rotation of said rotor, said second rotor cutting edges being disposed in a second plane perpendicular to the axis of rotation of said rotor, said first plane being spaced from said second plane.

* * * * *